United States Patent [19]

Preuss et al.

[11] Patent Number: 4,649,247

[45] Date of Patent: Mar. 10, 1987

[54] CONTACT ASSEMBLY FOR LOW-VOLTAGE CIRCUIT BREAKERS WITH A TWO-ARM CONTACT LEVER

[75] Inventors: Bernhard Preuss; Karl-Heinz Manthe, both of Berlin, Fed. Rep. of Germany

[73] Assignee: Siemens Aktiengesellschaft, Berlin and Munich, Fed. Rep. of Germany

[21] Appl. No.: 767,579

[22] Filed: Aug. 20, 1985

[30] Foreign Application Priority Data

Aug. 23, 1984 [DE] Fed. Rep. of Germany ..... 3431288

[51] Int. Cl.[4] ..... H01H 1/32

[52] U.S. Cl. ..... 200/244; 200/248; 335/195

[58] Field of Search ..... 200/244, 248, 249, 251, 200/287, 318; 335/195, 16, 6

[56] References Cited

U.S. PATENT DOCUMENTS

| | | | |
|---|---|---|---|
| 2,274,917 | 3/1942 | Carlson et al. | 200/68.2 |
| 3,004,125 | 10/1961 | Prien et al. | 200/244 |
| 3,177,332 | 4/1965 | Bethke | 200/251 |
| 3,402,273 | 9/1968 | Davis | 200/305 |
| 4,567,455 | 1/1986 | Hosogai et al. | 335/195 |

FOREIGN PATENT DOCUMENTS

| | | |
|---|---|---|
| 708972 | 8/1941 | Fed. Rep. of Germany . |
| 932191 | 8/1955 | Fed. Rep. of Germany . |
| 2157927 | 5/1973 | Fed. Rep. of Germany . |
| 2845950 | 4/1980 | Fed. Rep. of Germany . |

*Primary Examiner*—Charles E. Phillips
*Assistant Examiner*—Renee S. Luebke
*Attorney, Agent, or Firm*—Volker R. Ulbrich

[57] ABSTRACT

A contact assembly is provided for current-limiting low-voltage circuit breakers. The contact assembly has a two-armed contact lever swivel-mounted on a central bearing pin whose lever arms are equipped at their ends with contact pieces. The contact lever is equipped with a slot for mounting on the bearing pin whose longitudinal axis extends approximately at a right angle to the longitudinal axis of contact lever. The contact lever has a stop extending at approximately a right angle to its longitudinal axis for a catch swivel-mounted on the bearing pin. The contact forces on both lever arms cannot be influenced by the swivel mount or by the drive mechanism of the contact lever, but are determined exclusively by the biasing springs.

6 Claims, 3 Drawing Figures

CONTACT ASSEMBLY FOR LOW-VOLTAGE CIRCUIT BREAKERS WITH A TWO-ARM CONTACT LEVER

BACKGROUND OF THE INVENTION

This invention pertains to a contact assembly for low-voltage circuit breakers, specifically current-limiting circuit breakers with a two-arm contact lever which rotates around a central rotary axis, with the lever equipped at its ends on opposite sides of a longitudinal axis crossing the rotary axis with one contact piece on each side and having a biasing spring assigned to each lever arm.

A contact assembly of the above specified said type is disclosed in German Offenlegungsschrift No. 2,157,927. This contact assembly, in principle, has the advantage that no flat flexible conductor is necessary in the current path of the switch, since the two-arm contact lever bridges two fixed-mounted counter-connection pieces. Thus, when switching, two disconnect points connected in series are created. In conjunction with the relatively low energy requirement of a rotating lever device, one has the prerequisites for a high breaking capacity.

Even with these advantages, however, there are mechanical problems. In particular, it is difficult to assure the constancy of contact forces at the two disconnect points which is absolutely required for proper long-term operation. Moreover, fairly difficult problems are raised by the placement of the biasing springs and the transmission of the driving force into the contact lever. Accordingly, it will be appreciated that it would be highly desirable to provide a contact assembly which assures constancy of contact forces.

It is an object of the present invention to provide a contact assembly for a circuit breaker.

Another object of the invention is to provide a contact assembly which assures constancy of contact forces.

SUMMARY OF THE INVENTION

Briefly stated, in accordance with one aspect of the invention, a contact assembly is provided for a circuit breaker of the type which has a two-armed contact lever swivel-mounted on a central bearing and equipped with a contact piece at each end on opposite facing sides of a longitudinal axis which crosses the rotating axis of a swivel mount. Each lever arm is assigned a biasing spring. The bearing has a bearing pin and a slot enclosing the bearing pin whose longitudinal axis extends approximately at a right angle to the longitudinal axis of the contact lever. The contact lever has at least one stop extending approximately at a right angle to its longitudinal axis and is mateable with a catch swivelling on the rotary axis and moving the contact lever in the switch-off direction.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
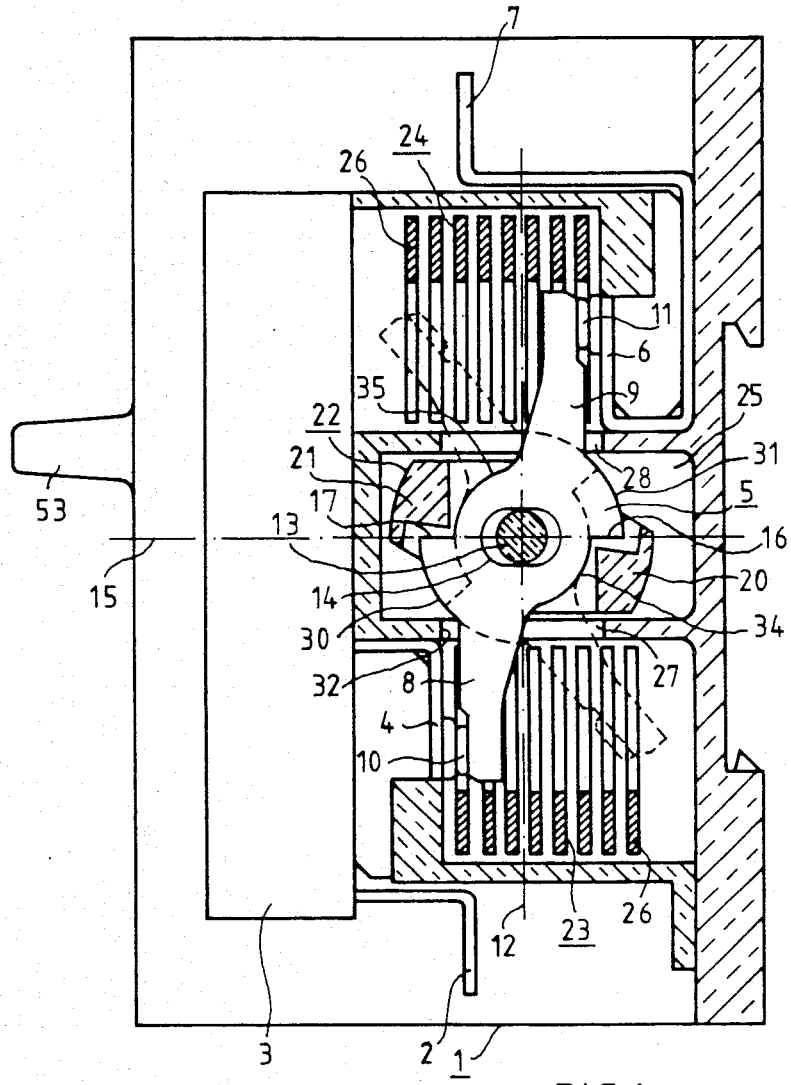
FIG. 1 is a simplified longitudinal sectional view of a contact assembly in accordance with this invention.

Referring to FIG. 1, a contact assembly is shown mounted in a compartment of housing 1. This housing consists of an insulating material and can be designed with one or more sections. Housing 1 is shown in FIG. 1 in its general outline with the additional components required for a low-voltage circuit breaker, such as drive, latch mechanism, connecting assemblies and other well-known items which are not shown. The figure simply shows the main current path of one pole of a circuit breaker which extends from a first terminal or connecting bar 2 over a schematically shown release switch unit 3 to a first fixed-mounted contact piece 4. From the contact piece 4 current flows over a swivel-mounted contact lever 5 to another fixed-mounted contact piece 6 and a terminal or connecting bar 7. The contact lever 5 is fitted at its opposite ends with contact pieces 10, 11 which work in conjunction with the fixed-mounted contact pieces 4, 6. Contact pieces 10 and 11 of the contact lever 5 are mounted on opposite sides of the longitudinal axis 12 of the contact lever. By rotating contact lever 5 counterclockwise, contact pieces 10 and 11 can be simultaneously separated from the fixed-mounted contact pieces 4 and 6.

For mounting contact lever 5, there is a fixed-mounted bearing pin 13 which is either insulated or made of insulating material in the housing 1, in conjunction with a central slot 14 of contact lever 5. While the dimension of slot 14 in the direction of the longitudinal axis 12 is in accordance with the diameter of bearing pin 13 with a standard tolerance, contact lever 5 can shift transversely to its longitudinal axis 12 along bearing pin 13, since the longitudinal axis 15 of slot 14 also runs at right angles to the longitudinal axis 12 of the contact lever. The contact forces arising between contact piece 4 and 10 or 6 and 11 are then independent of the mounting of contact lever 5 and reflect only the effect of biasing springs 47 and 48, whose assembly will be explained below based on FIG. 2.

FIG. 1 also shows that the contact lever 5 has two stops 16 and 17 facing the bearing shaft. These are designed for joint action along catches 20 and 21 which are integral to a switching shaft 22 made of insulating material, which is rotary-mounted on bearing pin 13. The stops 16 and 17 are positioned along the longitudinal axis 15 of slot 14. A shift of bearing pin 13 brought about by realignment of contact lever 5 thus has no effect on the interaction between stops 16 and 17 and catches 20 and 21. In the switch-on position shown the catches 20 and 21 are raised from stops 16 and 17 so that, aside from any bearing friction between bearing pin 13 and slot 14, only the biasing springs have any effect.

Between catch 20 and arm 8, as well as between catch 21 and arm 9, there is adequate space to create play so that contact lever 5 can rotate with switching shaft 22 in an unchanged position under the impact of current forces. For that purpose the central section of contact lever 5, which is overlapped by catches 20 and 21, is also fitted with similarly circular-shaped sections 34 and 35. As is well known, the design can ensure, by a locking assembly (not shown), that contact lever 5 is held fast in its eletrodynamically opened position until release of the latch.

Housing 1 is subdivided in the area of the contact assembly shown by partitions so that a first arcing compartment 23 and a second arcing compartment 24 as well as a middle pocket 25 are formed. The usual extinguishing plate assemblies 25 and 26 are located in the arcing compartments. The middle pocket 25 is designed to accommodate the switching shaft 22 and the biasing springs, as will be explained further below. The partitions of pocket 25 limit slots 27 and 28 designed to permit passage of arms 8 and 9 of contact lever 5. Circular-shaped components 30 and 31 of the unit are positioned near the center of contact lever 5 at a slight distance facing edges 32 and 33, which limit slots 27 and 28. The points are located on the side of contact lever 5 with arms 8 or 9 which are on the side of contact pieces 10 and 11. Thus at each angle setting of contact lever 5 a good sealing of the switching arc formation area relative to pocket 25 is attained. Thereby no switching gases can penetrate into pocket 25.

Figure 2:
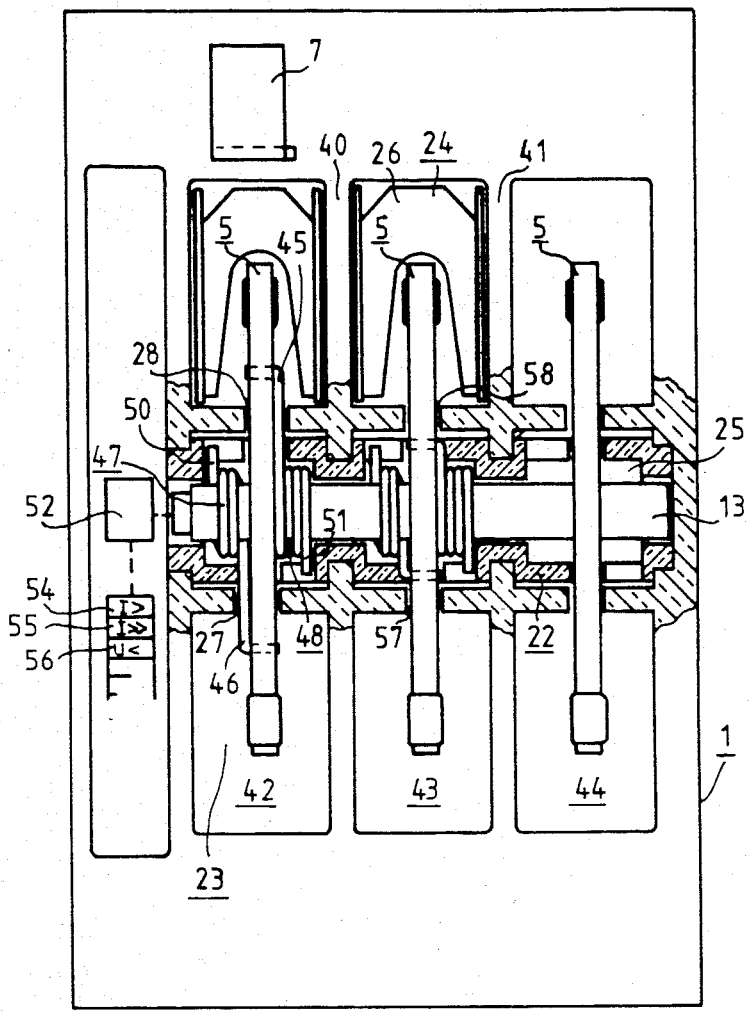
FIG. 2 is a partially sectioned plan view of a three-pole switch with adjoining current paths in accordance with FIG. 1.

Referring to FIG. 2, the housing 1 is equipped with adjoining areas to install three parallel current paths in accordance with FIG. 1. Bearing pin 13 extends over all current paths as does switching shaft 22 which is swivel-mounted on bearing pin 13. In the area of partitions 40 and 41 between the adjoining current paths 42, 43 and 44 the switching shaft is designed so that it encloses the partitions forming a labyrinth gap. One does not, however, have to tightly dimension this gap since the load on pockets 25 by arcing gases is relatively low, as has already been noted. In this connection, FIG. 2 shows that slots 27 and 28 between the partioning of pockets 25 are sized so that the contact lever can rotate without impediment. The slots are wide enought so that arms 45 and 46 of biasing springs 47 and 48 which are designed as torsion springs also find space beside arms 8 and 9 of contact lever 5. Arms 45 and 46 can, however, be shortened, in contrast to the example shown, to the extent that they contact arms 8 and 9 still within pocket 25 in order to facilitate adjusting the slot width to the thickness of arms 8 and 9. This is shown in the section indicating the middle current path 43 where the narrower slots are designated 57 and 58.

Torsion springs 47 and 48 always have another arm 50 or 51 supported by switching shaft 22. By the symmetrical arrangement of two biasing springs for each contact lever, the design avoids any one-sided load and the balance of the contact forces is assured.

FIG. 2 schematically shows that switching shaft 22 is connected at one end to a drive device which has a latch 52 and a manual actuation link 53 (FIG. 1). In addition, latch 52 is connected to release switches which in this embodiment are shown as an overload switch 54, a short-circuit release switch 55 and an undervoltage release switch 56.

The above-described low-voltage circuit breaker operates with high current limitation. This characteristic is based upon the looping current leads to the fixed-mounted contact pieces 4 and 6. This arrangement means that arms 8 and 9 and contact lever 5 face the bus bars supporting contact pieces 4 and 5 at a small distance only so that high currents exert a torque on contact lever 5 moving it in the opening direction. Under the impact of this torque, contact lever 5 is moved to the position shown in broken lines in FIG. 1. This design thereby limits the short-circuit current. Immediately following the dynamic contact opening, the latch 52 is released (FIG. 2) since the short-circuit current also activates release switch 55.

Figure 3:
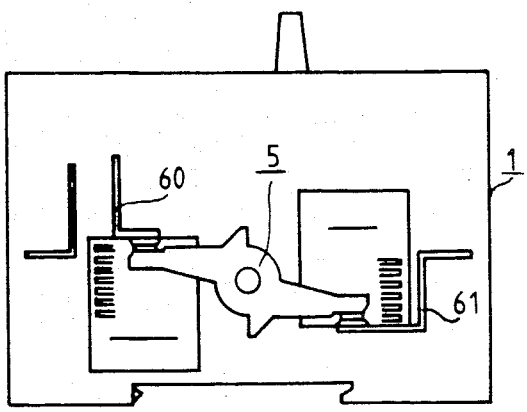
FIG. 3 is a simplified view of a contact assembly without current loops.

It should be noted that the described low-voltage circuit breaker also has a current-limiting characteristic if the power feed is not designed in the loop pattern shown since even between the contact pieces themselves current-dependent contact separating forces arise which have a greater impact due to the dual-contact assembly than they would in single-contact assemblies. An example in this regard is shown in a simplified fashion in FIG. 3. The connecting bars shortened in contrast to FIG. 1 are herein designated as 60 and 61. By the design of the power feed to the fixed-mounted contact pieces 4 and 6 the desired amount of current limitation can thus be influenced.

It will now be understood that there has been disclosed an improved contact assembly which improves the mounting, drive and contactor force generation of a rotary contact system. The contact lever mount incorporates a bearing pin and a slot enclosing the bearing pin, whose longitudinal axis is positioned at approximately a right angle to the longitudinal axis of the contact lever. The the contact lever incorporates at least one stop aligned at approximately a right angle to its longitudinal axis to accommodate a catch which is movable around the rotary axis and actuates the contact lever for switch-off. The slot permits an alignment of the contact lever so that the same forces always act upon the contact pieces, regardless of the unavoidable and possibly varying material burn-off during operation. This positioning cannot be impeded by a drive assembly of the contact lever, since the position of the stop on the contact lever also permits its alignment to the catch.

In principle it does not matter whether the bearing pin is fixedly-connected to the switch lever or fixedly-mounted separately from the latter, since in both cases the contact lever can be properly aligned. For multi-pole switchgear in which the contact levers are installed in parallel-mounted switching compartments, it is, however, advantageous to design the unit with a common fixed-mounted bearing pin and to install the slot at the contact levers.

The contact lever can be equipped with two stops aligned symmetrically to its center, and there can also be two catches. The assembly thereby attains symmetrical points of application of force.

Effective power limitation can be attained by having the catch or catches installed relative to the contact lever with adequate play so that the contact lever can move to its opening position given unchanged setting of the catch or catches. The opening position can correspond to the normal switch-off setting or even a larger opening angle if a high current limitation is desired. In this context it is advantageous if the rotation of the contact lever can take place only against the action of the biasing spring, independently of the drive parts.

The catches can be integral to a switching shaft which rotates around the bearing pin. Onto said switching shaft a drive force can be introduced from a compartment or section positioned next to the switching compartment and well separated from it. In addition, the switching shaft is best suited to provide the common drive of the contactor levers of a multi-pole switch. The contact springs can be preferably designed as torsion springs enclosing the bearing pin, whose one arm is supported by a facing surface of the switching shaft and whose other arm is supported by the contact lever. The contact springs in this assembly are relatively far away from the contact points, thereby reducing the danger that the characteristics of the contact springs would be adversely affected by the switching arcs.

It is preferable to install the biasing springs designed as torsion springs on both sides of the contact lever in such a fashion that each is slid into a pocket of a housing supporting the contact assembly, with the wall sections of the pocket defining certain slots for passage of the arms of the contact lever. The wall sections thereby form an additional protection of the contact springs against any impairment by switching arcs.

The best protection of the contact springs from this perspective can be attained by having the torsion springs mesh at one end with sections of the contact lever positioned inside the pockets.

It is of further advantage if the contact lever is designed in the shape of an arc circle in its center on the side facing the contact pieces. Thus the space between the contact lever and the wall sections at this point remains the same, regardless of the angle setting during switching, so that the arcing gases arising during switching face a high resistance to flow. This not only provides additional protection to the biasing springs, but also reduces any load on the bearing gap of the switching shaft due to the arcing gases and the gas passage to the adjoining phase. At the bearings of the switching shaft between adjoining current paths of a switch, one can thus permit a relatively coarse tolerance which simplifies the fabrication of a single-unit switching shaft for multi-pole switches.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A contact assembly for a low-voltage circuit breaker having a two-armed contact lever and being equipped with a contact piece at each end on opposite facing sides of a longitudinal axis and each lever arm being assigned a biasing spring, comprising:

a swivel mount for the contact lever having a fixed bearing pin for providing an axis of rotation and a slot in the contact arm enclosing the bearing pin, the longitudinal axis of the slot extending approximately at a right angle to the longitudinal axis of the contact lever, and said contact lever having at least one stop surface extending approximately at a right angle to the longitudinal axis of the contact lever and being matable with a catch, the catch being an integral component of a switching shaft which is swivel-mounted on the bearing pin for moving the contact lever in the switch-off direction.

2. A contact assembly in accordance with claim 1, wherein the contact lever includes two stop surfaces arranged symmetrically about its center and the switching shaft includes two catches for engaging the stop surfaces.

3. A contact assembly in accordance with claim 1, wherein the catch faces the contact lever which has adequate play so that the contact lever can move into an open position while the catch remains in an unchanged position.

4. A contact assembly in accordance with claim 1, wherein each biasing spring is a torsion spring which encloses the bearing pin and which has one arm supporting itself on a facing surface of the switching shaft and another arm supporting itself against the contact lever and wherein the two torsion springs are arranged on both sides of the contact lever, each spring being mounted in a pocket of a housing supporting the contact assembly with pocket partitioning wall parts restricting slots which permit passage of the arms of the contact lever.

5. A contact assembly in accordance with claim 4, wherein one end of each of the torsion springs engages a section of a respective contact lever inside of the pocket.

6. A contact assembly in accordance with claim 4, wherein the contact lever has a central portion with two arcuate sections from each of which a respective lever arm extends, each of said arcuate sections facing in the direction of the contact piece of said respective lever arm.

* * * * *